US011772244B2

(12) United States Patent
Sherwani et al.

(10) Patent No.: US 11,772,244 B2
(45) Date of Patent: Oct. 3, 2023

(54) RATCHETING SCREWDRIVER ASSEMBLY

(71) Applicants: Aram Sherwani, Nashville, TN (US); Rebaz Hameed, Nashville, TN (US)

(72) Inventors: Aram Sherwani, Nashville, TN (US); Rebaz Hameed, Nashville, TN (US)

( * ) Notice: Subject to any disclaimer, the term of this patent is extended or adjusted under 35 U.S.C. 154(b) by 113 days.

(21) Appl. No.: 17/495,138

(22) Filed: Oct. 6, 2021

(65) Prior Publication Data

US 2023/0105845 A1 Apr. 6, 2023

(51) Int. Cl.
*B25B 15/04* (2006.01)

(52) U.S. Cl.
CPC ..... *B25B 15/04* (2013.01)

(58) Field of Classification Search
CPC ..... B25B 15/04
USPC ..... 81/57.39, 29–34
See application file for complete search history.

(56) References Cited

U.S. PATENT DOCUMENTS 1,519,951 A * 12/1924 Bowman ..... B23B 45/06 81/34
2,421,901 A * 6/1947 Murad ..... B23B 45/06 408/124
2,667,194 A * 1/1954 Fischer ..... B25B 23/0035 81/DIG. 11
3,035,451 A * 5/1962 O'Connell ..... B25B 13/467 81/34
4,741,059 A 5/1988 Lee
5,309,796 A * 5/1994 Jones ..... B25B 13/463 81/57.39
5,673,841 A 10/1997 Schulze
6,343,530 B1 * 2/2002 Huang ..... B25B 17/00 81/58.4
7,191,677 B2 * 3/2007 Barkdoll ..... B23Q 5/045 81/57.28
8,875,973 B2 11/2014 Whitman
8,910,846 B2 12/2014 Viola

FOREIGN PATENT DOCUMENTS

EP 2644336 3/2013

* cited by examiner

*Primary Examiner* — Hadi Shakeri

(57) ABSTRACT

A ratcheting screwdriver assembly includes a handle and a lever that is pivotally disposed on the handle. The lever is urgeable into an engaged position and the lever is biased into a disengaged movement. A shaft is rotatably disposed in the handle. A plurality of bits is provided and a respective one of the bits is insertable into the shaft to engage a respective type of fastener. A direction selector is movably integrated into the lever and the direction selector is in mechanical communication when the shaft. The direction selector is positionable in a tightening condition to tighten the fastener when the lever is urged into the engaged position. The direction selector is positionable in a loosening condition to loosen the fastener when the lever is urged into the engaged position.

12 Claims, 5 Drawing Sheets

RATCHETING SCREWDRIVER ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to screwdriver devices and more particularly pertains to a new screwdriver device for tightening or loosening a fastener in the convention of a screwdriver. The device includes a handle and a shaft that is rotatably integrated into the handle. The device includes a lever that is pivotally integrated into the handle and which is urgeable into an engaging position. The device further includes a direction selector for rotating the shaft in a first direction or a second direction. The shaft rotates each time the lever is urged into the engaging position thereby facilitating the bit to either loosen or tighten the fastener, depending on the position of the direction selector.

(2) Description of Related Art Including Information Disclosed Under 37 CFR 1.97 and 1.98

The prior art relates to screwdriver devices including a utility knife multi-tool. the prior art discloses a multiple tool device comprising a plurality of tools combined with pliers. The prior art discloses a surgical instrument that includes a lever that is urgeable into an engaging position to actuate a surgical head. The prior art discloses a cutting and stapling device that includes a pair of jaws that are urgeable together. The prior art discloses a surgical instrument that includes a pinion gear and a rack gear.

(h) BRIEF SUMMARY OF THE INVENTION

An embodiment of the disclosure meets the needs presented above by generally comprising a handle and a lever that is pivotally disposed on the handle. The lever is urgeable into an engaged position and the lever is biased into a disengaged movement. A shaft is rotatably disposed in the handle. A plurality of bits is provided and a respective one of the bits is insertable into the shaft to engage a respective type of fastener. A direction selector is movably integrated into the lever and the direction selector is in mechanical communication when the shaft. The direction selector is positionable in a tightening condition to tighten the fastener when the lever is urged into the engaged position. The direction selector is positionable in a loosening condition to loosen the fastener when the lever is urged into the engaged position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
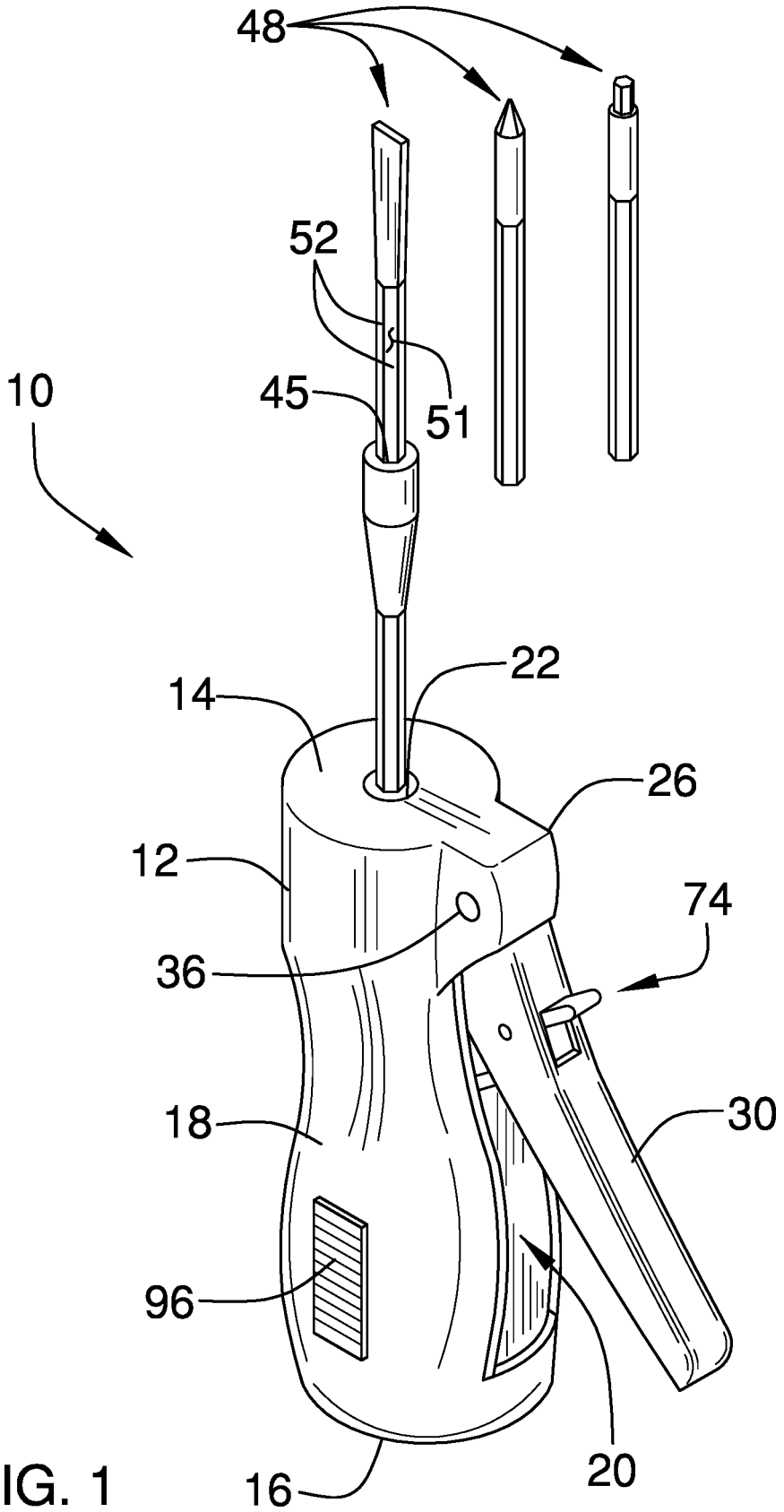
FIG. 1 is a perspective view of a ratcheting screwdriver assembly according to an embodiment of the disclosure.
Figure 2:
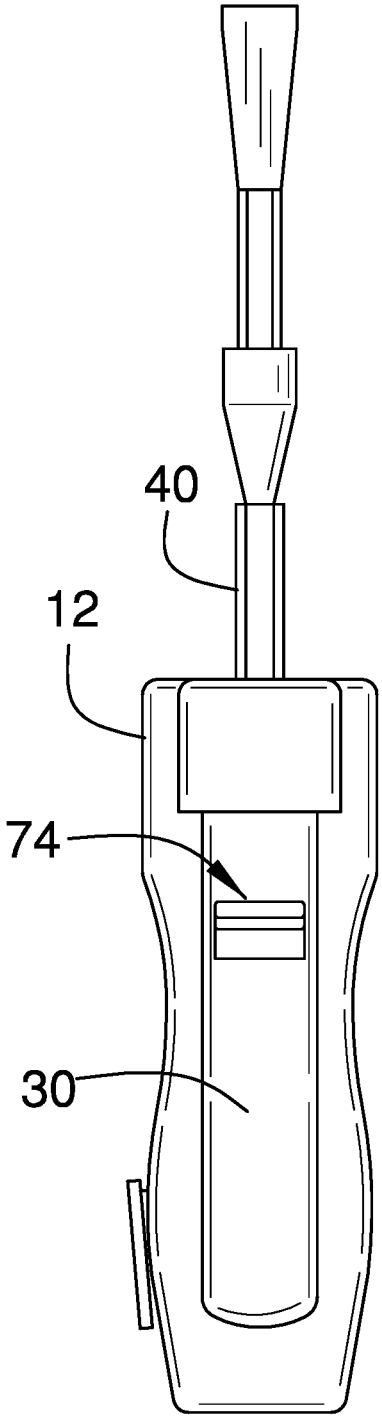
FIG. 2 is a front view of an embodiment of the disclosure.
Figure 3:
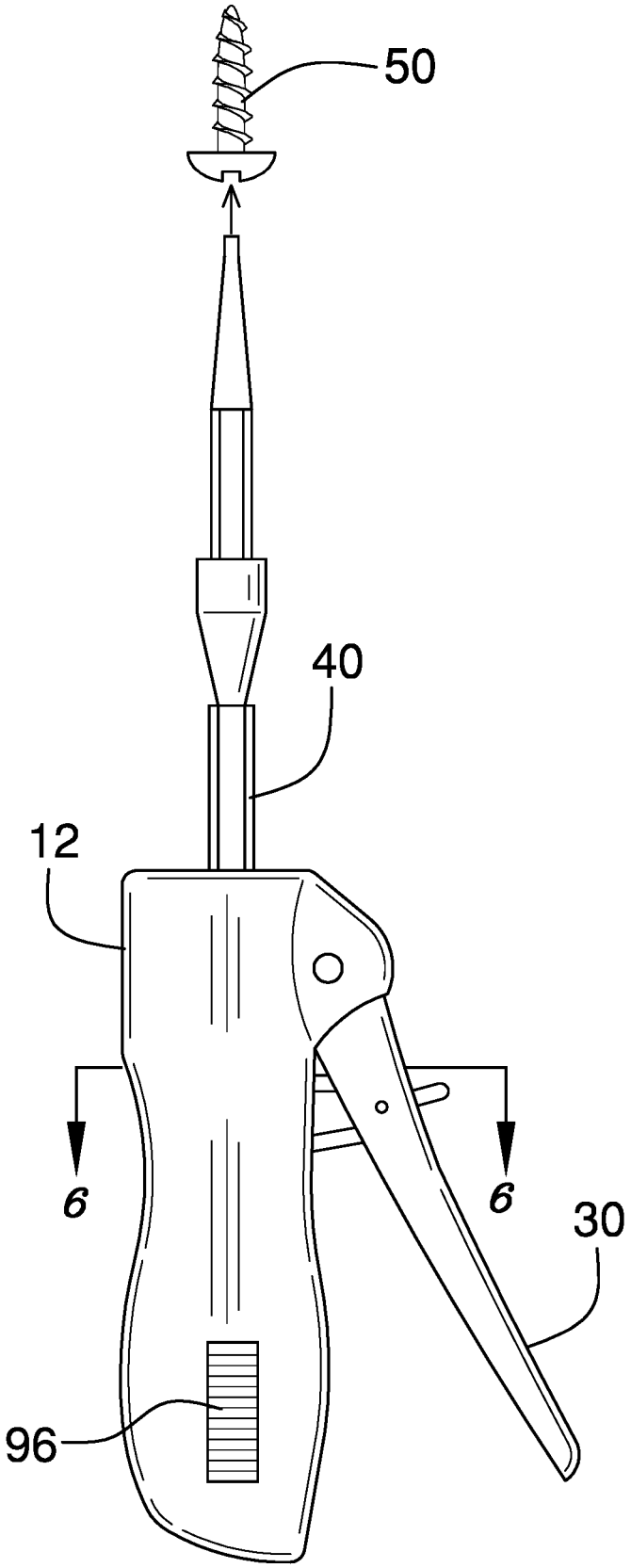
FIG. 3 is a right side view of an embodiment of the disclosure.
Figure 4:
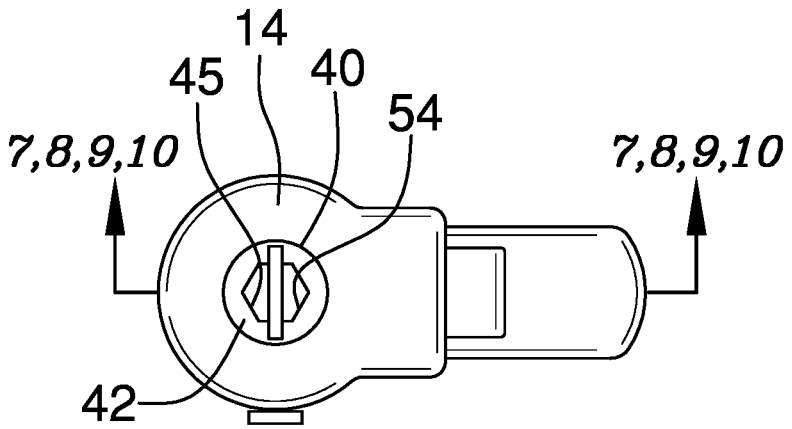
FIG. 4 is a top view of an embodiment of the disclosure.
Figure 5:
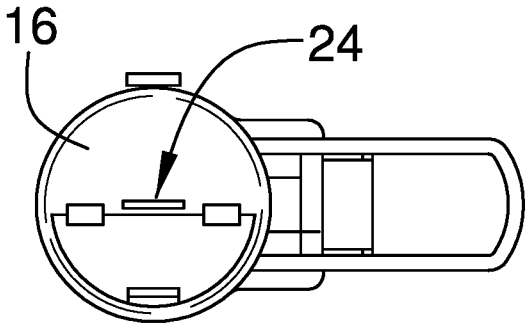
FIG. 5 is a bottom view of an embodiment of the disclosure.
Figure 6:
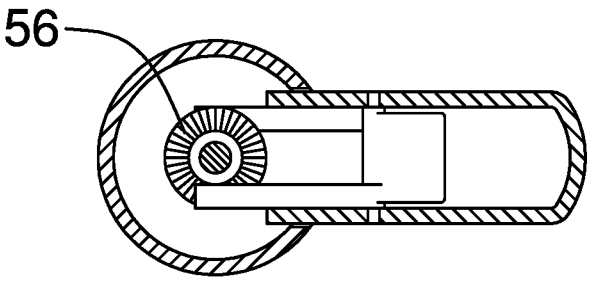
FIG. 6 is a cross sectional view taken along line 6-6 of FIG. 3 of an embodiment of the disclosure.
Figure 7:
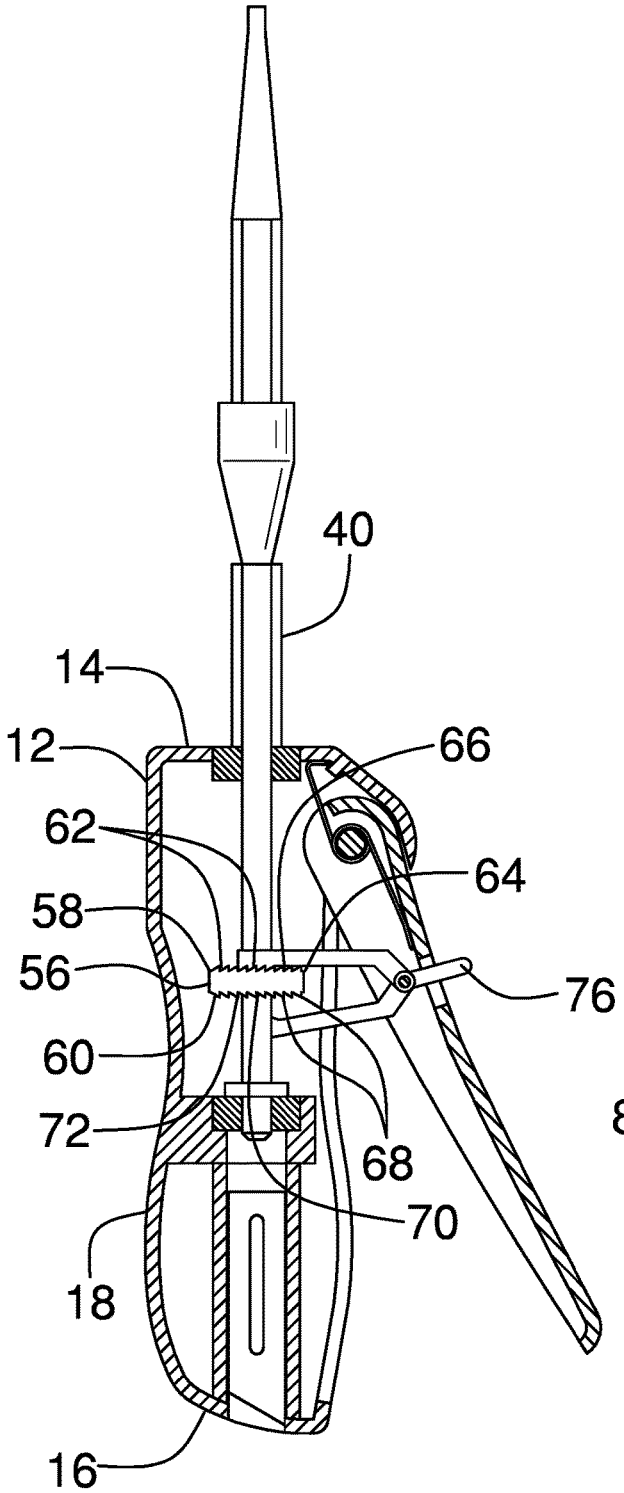
FIG. 7 is a cross sectional view taken along line 7-7 of FIG. 4 of an embodiment of the disclosure.
Figure 8:
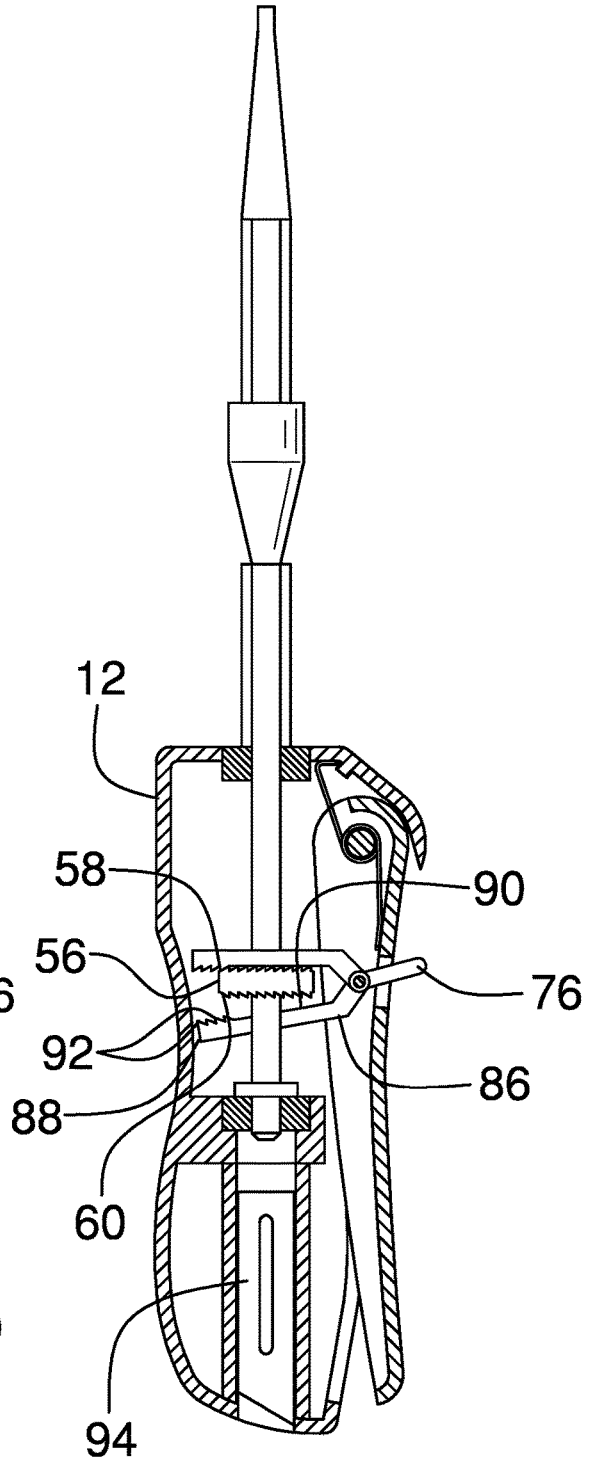
FIG. 8 is a cross sectional view taken along line 8-8 of FIG. 4 of an embodiment of the disclosure.
Figure 9:
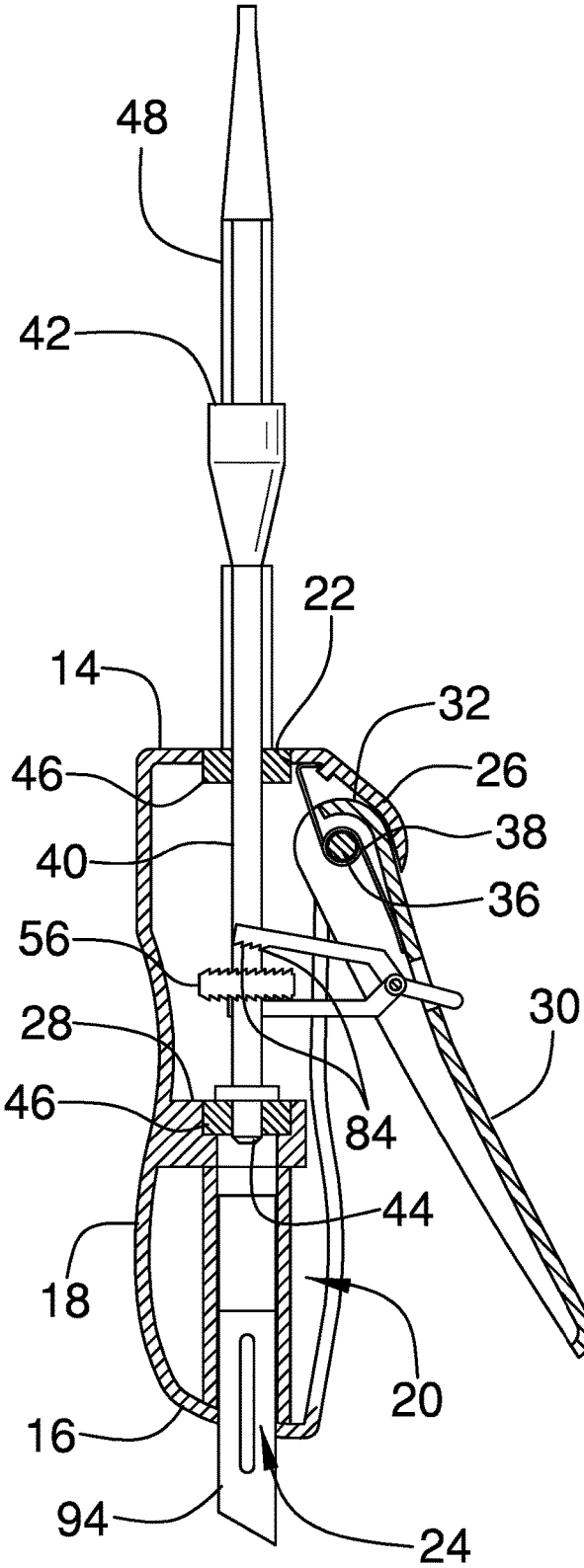
FIG. 9 is a cross sectional view taken along line 9-9 of FIG. 4 of an embodiment of the disclosure.
Figure 10:
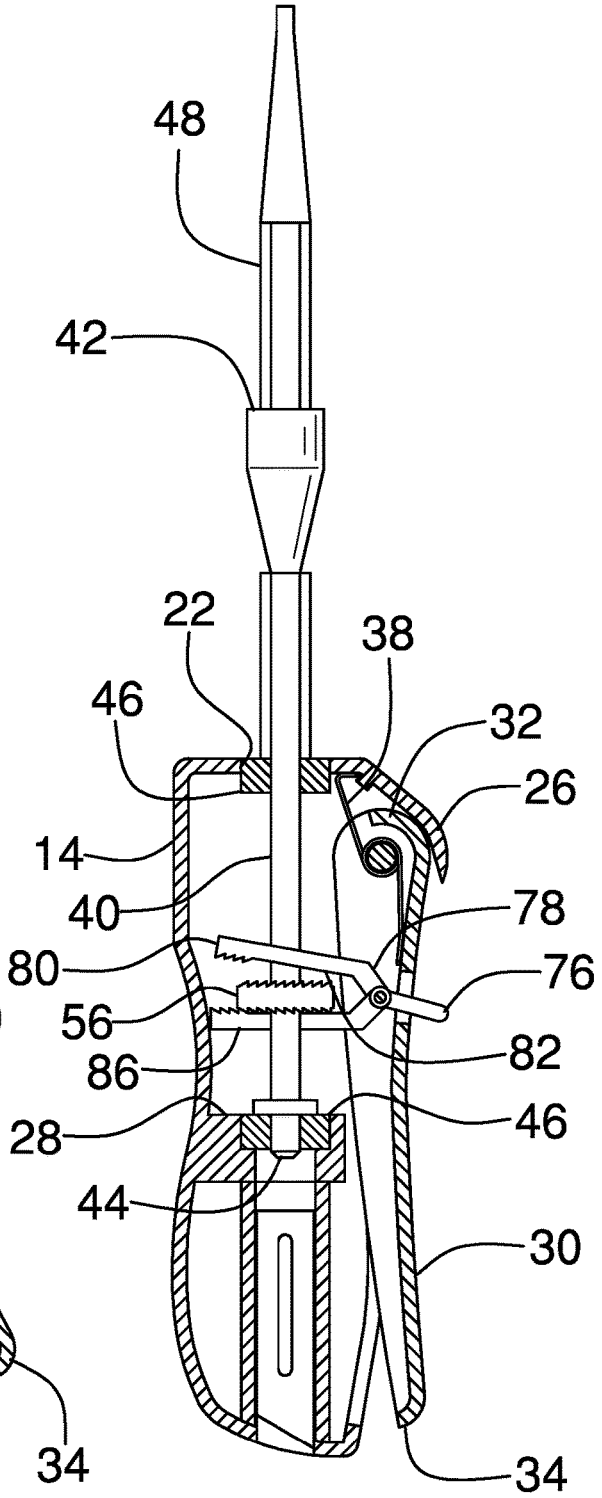
FIG. 10 is a cross sectional view taken along line 10-10 of FIG. 4 of an embodiment of the disclosure.

With reference now to the drawings, and in particular to FIGS. 1 through 10 thereof, a new screwdriver device embodying the principles and concepts of an embodiment of the disclosure and generally designated by the reference numeral 10 will be described.

As best illustrated in FIGS. 1 through 10, the ratcheting screwdriver assembly 10 generally comprises a handle 12 that is elongated for gripping. The handle 12 has a first end 14, a second end 16 and an outer wall 18 extending between the first end 14 and the second end 16, and the handle 12 is substantially hollow. The outer wall 18 has an opening 20 extending into an interior of the handle 12 and the opening 20 extends substantially between the first end 14 and the second end 16. The first end 14 has a hole 22 extending into the interior of the handle 12, the hole 22 is centrally positioned on the first end 14 and the second end 16 has a slot 24 extending into the interior of the handle 12. The outer wall 18 has a pivot hood 26 extending outwardly from the outer wall 18 and the pivot hood 26 is positioned between the opening 20 and the first end 14. The handle 12 has a shaft support 28 which is positioned within the handle 12.

A lever 30 is pivotally disposed on the handle 12 and the lever 30 can be manipulated by the user. The lever 30 is urgeable into an engaged position and the lever 30 is biased into a disengaged movement. The lever 30 has a coupled end 32 and a free end 34, and the coupled end 32 is positioned in the pivot hood 26. The lever 30 includes a pin 36 which extends through the pivot hood 26 and engages the lever 30 such that the lever 30 is pivotally coupled to the pivot hood 26. The lever 30 lies against the outer wall 18 of the handle 12 when the handle 12 is in the engaged position. Conversely, the lever 30 angles away from the outer wall 18 when the handle 12 is in the disengaged position. A biasing member 38 is integrated into the pivot hood 26, the biasing member 38 engages the lever 30 and the biasing member 38 biases the lever 30 into the disengaged position.

A shaft 40 is rotatably disposed in the handle 12 and the shaft 40 extends outwardly through the handle 12. The shaft 40 has an exposed end 42 with respect to the handle 12 and a coupled end 44. The shaft 40 extends through a bearing 4 in the hole 22 in the first end 14 of the handle 12 and the exposed end 42 is open into a polygonal receiving well 45. The coupled end 44 of the shaft 40 rotatably engages a bearing 46 in the shaft support 28 in the handle 12 such that the shaft 40 is rotatable about an axis extending between the exposed end 42 and the coupled end 44 of the shaft 40.

A plurality of bits 48 is provided and each of the bits 48 is insertable into the shaft 40 to engage a respective type of fastener 50. The fastener 50 may be a Phillips head screw, a slotted screw or any other type of threaded fastener 50 that has one of a plurality of conventional heads. Each of the bits 48 is insertable into the exposed end 42 of the shaft 40. Each of the bits 48 has an outer surface 51 comprising a plurality of intersecting sides 52 such that the outer surface 51 conforms to a bounding surface 54 of the polygonal receiving well 45. In this way the shaft 40 can rotate the bit 48 that is positioned in the exposed end 42. The plurality of bits 48 might include Phillips bits, torx bits, slotted bits and any other bits that are commonly associated with cordless drill bits, for example.

A gear 56 is positioned around the shaft 40 and the gear 56 is in mechanical communication with the lever 30. The gear 56 is rotated when the lever 30 is urged into the engaged position thereby facilitating the shaft 40 to be rotated. In this way the bit in the shaft 40 can rotate the fastener 50. The gear 56 has a top side 58 and a bottom side 60, and the top side 58 has a plurality of first teeth 62 that is each integrated into the top side 58. The first teeth 62 are spaced apart from each other and are distributed around the top side 58. Each of the first teeth 62 has a front surface 64 and a top surface 66, and the front surface 64 extends upwardly from the top side 58. Furthermore, the top surface 66 slopes downwardly between the front surface 64 and the top side 58.

The bottom side 60 has a plurality of second teeth 68 that is each integrated into the bottom side 60. The second teeth 68 are spaced apart from each other and are distributed around the bottom side 60. Each of the second teeth 68 has a front surface 70 and a bottom surface 72, and the front surface 70 of the second teeth 68 extends downwardly from the bottom side 60. Additionally, the bottom surface 70 slopes upwardly between the front surface 70 of the second teeth 68 and the bottom side 60.

A direction selector 74 is movably integrated into the lever 30 and the direction selector 74 is in mechanical communication when the gear 56. The direction selector 74 is positionable in a tightening condition to facilitate the gear 56 to rotate in a first direction when the lever 30 is urged into the engaged position to tighten the fastener 50. Conversely, the direction selector 74 is positionable in a loosening condition thereby facilitating the gear 56 to rotate in a second direction when the lever 30 is urged into the engaged position to loosen the fastener 50.

The direction selector 74 includes a switch 76 that is pivotally disposed in the lever 30. The direction selector 74 includes a first arm 78 that is coupled to the switch 76 such that the first arm 78 extends into the interior of the handle 12. The first arm 78 has a distal end 80 with respect to the switch 76 and a lower surface 82. The lower surface 82 has a plurality of teeth 84 that are distributed from the distal end 80 toward the switch 76. The teeth 84 on the lower surface 82 are aligned with the top side 58 of the gear 56. The first arm 78 is lowered onto the top side 58 of the gear 56 when the switch 76 is positioned in a tightening position.

Additionally, the teeth 84 on the lower surface 82 engage the first teeth 62 when the first arm 78 is lowered onto the top side 58. The teeth 84 on the lower surface 82 engage the front surface 64 of the first teeth 62 when the lever 30 is urged into the engaged position such that the first arm 78 rotates the gear 56 in a first direction. Conversely, the teeth 84 on the lower surface 82 slide over the top surface 66 of the first teeth 62 when the lever 30 is biased into the disengaged position such that the gear 56 is not rotated.

The direction selector 74 includes a second arm 86 that is coupled to the switch 76 such that the second arm 86 extends into the interior of the handle 12. The second arm 86 has a distal end 88 with respect to the switch 76 and an upper surface 90. The upper surface 90 has a plurality of teeth 92 that are distributed from the distal end 80 toward the switch 76 and the teeth 92 on the upper surface 90 are aligned with the top side 58 of the gear 56. The second arm 86 is raised onto the bottom side 60 of the gear 56 when the switch 76 is positioned in a tightening position and the teeth 92 on the upper surface 90 engage the second teeth 68 when the second arm 86 is raised onto the top side 58.

The teeth 92 on the upper surface 90 engage the front surface 70 of the second teeth 68 when the lever 30 is urged into the engaged position such that the second arm 86 rotates the gear 56 in a second direction. Conversely, the teeth 92 on the upper surface 90 slide over the bottom surface 72 of the second teeth 68 when the lever 30 is biased into the disengaged position such that the gear 56 is not rotated. Each of the first arm 78 and the second arm 86 is positioned on opposite sides of the shaft 40 with respect to each other.

A blade 94 is slidably disposed in the handle 12 and the blade 94 is extendable outwardly through the slot 24 in the second end 16 of the handle 12 for cutting with the blade 94. The blade 94 is retractable into the interior of the handle 12 for storing the blade 94. A blade switch 96 is provided and the blade switch 96 is slidably integrated into the outer wall 18 of the handle 12. The blade switch 96 is slidable along an axis extending between the first end 14 and the second end 16 of the handle 12. Additionally, the blade switch 96 is in mechanical communication with the blade 94 for extending or retracting the blade 94. The blade 94 may be longitudinally elongated and the blade 94 may have an angled cutting edge.

In use, a respective one of the bits 48 is inserted into the shaft 40 to facilitate the respective bit 48 to engage the fastener 50. The direction selector 74 is positioned in the tightening condition and the lever 30 is alternatively urged into the engaged position and released. In this way the shaft 40 is rotated in a clockwise direction, each time the lever 30 urged into the engaged position, in order to tighten the fastener 50. The direction selector 74 is positioned in the loosening condition and the lever 30 is alternatively urged into the engaged position and released. In this way the shaft 40 is rotated in a counterclockwise direction, each time the lever 30 is urged into the engaged position, in order to loosen the fastener 50. Thus, the fastener 50 can be loosened or tightened in the convention of employing a screwdriver without requiring the user to manually rotate their wrist.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A ratcheting screwdriver assembly for automatically rotating a screwdriver without battery power, said assembly comprising:

a handle being elongated wherein said handle is configured to be gripped;

a lever being pivotally disposed on said handle wherein said lever is configured to be manipulated by the user, said lever being urgeable into an engaged position, said lever being biased into a disengaged movement;

a shaft being rotatably disposed in said handle, said shaft extending outwardly through said handle;

a plurality of bits, a respective one of said bits being insertable into said shaft wherein each of said bits is configured to engage a respective type of fastener;

a gear being positioned around said shaft, said gear being in mechanical communication with said lever, said gear being rotated when said lever is urged into said engaged position thereby facilitating said shaft to be rotated wherein said bit in said shaft is configured to rotate the fastener, a direction selector being movably integrated into said lever, said direction selector being in mechanical communication with said gear, said direction selector being positionable in a tightening condition thereby facilitating said gear to rotate in a first direction when said lever is urged into said engaged position wherein said bit in said shaft is configured to tighten the fastener, said direction selector being positionable in a loosening condition thereby facilitating said gear to rotate in a second direction when said lever is urged into said engaged position wherein said bit in said shaft is configured to loosen the fastener;

wherein said handle has a first end, a second end and an outer wall extending between said first end and said second end, said handle being substantially hollow;

wherein said outer wall has an opening extending into an interior of said handle, said opening extending substantially between said first end and said second end;

wherein said first end has a hole extending into said interior of said handle, said hole being centrally positioned on said first end;

wherein said second end has a slot extending into said interior of said handle;

wherein said outer wall has a pivot hood extending outwardly from said outer wall, said pivot hood being positioned between said opening and said first end;

wherein said handle has a shaft support being positioned within said handle; and wherein said direction selector includes a switch being pivotally disposed in said lever wherein said switch is configured to be manipulated by the user;

a first arm being coupled to said switch such that said first arm extends into said interior of said handle; and a second arm being coupled to said switch such that said second arm extends into said interior of said handle.

2. The assembly according to claim 1, wherein said lever has a coupled end and a free end, said coupled end being positioned in said pivot hood, said lever including a pin extending through said pivot hood and engaging said lever such that said lever is pivotally coupled to said pivot hood, said lever lying against said outer wall of said handle when said handle is in said engaged position, said lever angling away from said outer wall when said handle is in said disengaged position.

3. The assembly according to claim 1, wherein said shaft has an exposed end with respect to said handle and a coupled end, said shaft extending through a bearing in said hole in said first end of said handle, said exposed end being open, said coupled end of said shaft rotatably engaging a bearing in said shaft support in said handle such that said shaft is rotatable about an axis extending between said exposed end and said coupled end of said shaft.

4. The assembly according to claim 3, wherein each of said bits is insertable into said exposed end of said shaft, each of said bits having an outer surface comprising a plurality of intersecting sides such that said outer surface conforms to a bounding surface defined in said exposed end thereby facilitating said shaft to rotate said bit that is positioned in said exposed end.

5. The assembly according to claim 1, wherein:

said gear has a top side and a bottom side;

said top side has a plurality of first teeth each being integrated into said top side, said first teeth being spaced apart from each other and being distributed around said top side, said first teeth having a front surface and a top surface, said front surface extending upwardly from said top side, said top surface sloping downwardly between said front surface and said top side; and said bottom side has a plurality of second teeth each being integrated into said bottom side, said second teeth being spaced apart from each other and being distributed around said bottom side, said second teeth having a front surface and a bottom surface, said front surface of said second teeth extending downwardly from said bottom side, said bottom surface of sloping upwardly between said front surface of said second teeth and said bottom side.

6. The assembly according to claim 1, wherein:

said gear has a top side and a bottom side;

said top side has a plurality of first teeth each being integrated into said top side, said first teeth having a front surface and a top surface, said front surface extending upwardly from said top side, said top surface sloping downwardly between said front surface and said top side; and said first arm has a distal end with respect to said switch and a lower surface, said lower surface having a plurality of teeth being distributed from said distal end toward said switch, said teeth on said lower surface being aligned with said top side of said gear, said first arm being lowered onto said top side of said gear when said switch is positioned in a tightening position, said teeth on said lower surface engaging said first teeth when said first arm is lowered onto said top side.

7. The assembly according to claim 6, wherein said teeth on said lower surface engage said front surface of said first teeth when said lever is urged into said engaged position such that said first arm rotates said gear in a first direction, said teeth on said lower surface sliding over said top surface of said first teeth when said lever is biased into said disengaged position such that said gear is not rotated.

8. The assembly according to claim 1, wherein:

said gear has a top side and a bottom side;

said top side has a plurality of first teeth each being integrated into said top side;

said bottom side has a plurality of second teeth each being integrated into said bottom side, said second teeth being spaced apart from each other and being distributed around said bottom side, said second teeth having a front surface and a bottom surface, said front surface of said second teeth extending downwardly from said bottom side, said bottom surface of sloping upwardly between said front surface of said second teeth and said bottom side; and said second arm has a distal end with respect to said switch and an upper surface, said upper surface having a plurality of teeth being distributed from said distal end toward said switch, said teeth on said upper surface being aligned with said bottom side of said gear, said second arm being raised onto said bottom side of said gear when said switch is positioned in a loosening position.

9. The assembly according to claim 8, wherein said teeth on said upper surface engaging said second teeth when said second arm is raised onto said bottom side, said teeth on said upper surface engaging said front surface of said second teeth when said lever is urged into said engaged position such that said second arm rotates said gear in a second direction, said teeth on said upper surface sliding over said top surface of said second teeth when said lever is biased into said disengaged position such that said gear is not rotated, each of said first arm and said second arm being positioned on opposite sides of said shaft with respect to each other.

10. The assembly according to claim 1, further comprising a blade being slidably disposed in said handle, said blade being extendable outwardly through said slot in said second end of said handle for cutting with said blade, said blade being retractable into said interior of said handle for storing said blade.

11. The assembly according to claim 10, further comprising a blade switch being slidably integrated into said outer wall of said handle, said blade switch being slidable along an axis extending between said first end and said second end of said handle, said blade switch being in mechanical communication with said blade for extending or retracting said blade.

12. A ratcheting screwdriver assembly for automatically rotating a screwdriver without battery power, said assembly comprising:

a handle being elongated wherein said handle is configured to be gripped, said handle having a first end, a second end and an outer wall extending between said first end and said second end, said handle being substantially hollow, said outer wall having an opening extending into an interior of said handle, said opening extending substantially between said first end and said second end, said first end having a hole extending into said interior of said handle, said hole being centrally positioned on said first end, said second end having a slot extending into said interior of said handle, said outer wall having a pivot hood extending outwardly from said outer wall, said pivot hood being positioned between said opening and said first end, said handle having a shaft support being positioned within said handle;

a lever being pivotally disposed on said handle wherein said lever is configured to be manipulated by the user, said lever being urgeable into an engaged position, said lever being biased into a disengaged movement, said lever having a coupled end and a free end, said coupled end being positioned in said pivot hood, said lever including a pin extending through said pivot hood and engaging said lever such that said lever is pivotally coupled to said pivot hood, said lever lying against said outer wall of said handle when said handle is in said engaged position, said lever angling away from said outer wall when said handle is in said disengaged position;

a biasing member being integrated into said pivot hood, said biasing member engaging said lever, said biasing member biasing said lever into said disengaged position;

a shaft being rotatably disposed in said handle, said shaft extending outwardly through said handle, said shaft having an exposed end with respect to said handle and a coupled end, said shaft extending through a bearing in said hole in said first end of said handle, said exposed end being open, said coupled end of said shaft rotatably engaging a bearing in said shaft support in said handle such that said shaft is rotatable about an axis extending between said exposed end and said coupled end of said shaft;

a plurality of bits, a respective one of said bits being insertable into said shaft wherein each of said bits is configured to engage a respective type of fastener, each of said bits being insertable into said exposed end of said shaft, each of said bits having an outer surface comprising a plurality of intersecting sides such that said outer surface conforms to a bounding surface defined in said exposed end thereby facilitating said shaft to rotate said bit that is positioned in said exposed end;

a gear being positioned around said shaft, said gear being in mechanical communication with said lever, said gear being rotated when said lever is urged into said engaged position thereby facilitating said shaft to be rotated wherein said bit in said shaft is configured to rotate the fastener, said gear having a top side and a bottom side, said top side having a plurality of first teeth each being integrated into said top side, said first teeth being spaced apart from each other and being distributed around said top side, said first teeth having a front surface and a top surface, said front surface extending upwardly from said top side, said top surface sloping downwardly between said front surface and said top side, said bottom side having a plurality of second teeth each being integrated into said bottom side, said second teeth being spaced apart from each other and being distributed around said bottom side, said second teeth having a front surface and a bottom surface, said front surface of said second teeth extending downwardly from said bottom side, said bottom surface of sloping upwardly between said front surface of said second teeth and said bottom side;

a direction selector being movably integrated into said lever, said direction selector being in mechanical communication with said gear, said direction selector being positionable in a tightening condition thereby facilitating said gear to rotate in a first direction when said lever is urged into said engaged position wherein said bit in said shaft is configured to tighten the fastener, said direction selector being positionable in a loosening condition thereby facilitating said gear to rotate in a second direction when said lever is urged into said engaged position wherein said bit in said shaft is configured to loosen the fastener, said direction selector including:

a switch being pivotally disposed in said lever wherein said switch is configured to be manipulated by the user, a first arm being coupled to said switch such that said first arm extends into said interior of said handle, said first arm having a distal end with respect to said switch and a lower surface, said lower surface having a plurality of teeth being distributed from said distal end toward said switch, said teeth on said lower surface being aligned with said top side of said gear, said first arm being lowered onto said top side of said gear when said switch is positioned in a tightening position, said teeth on said lower surface engaging said first teeth when said first arm is lowered onto said top side, said teeth on said lower surface engaging said front surface of said first teeth when said lever is urged into said engaged position such that said first arm rotates said gear in a first direction, said teeth on said lower surface sliding over said top surface of said first teeth when said lever is biased into said disengaged position such that said gear is not rotated; and a second arm being coupled to said switch such that said second arm extends into said interior of said handle, said second arm having a distal end with respect to said switch and a upper surface, said upper surface having a plurality of teeth being distributed from said distal end toward said switch, said teeth on said upper surface being aligned with said top side of said gear, said second arm being raised onto said bottom side of said gear when said switch is positioned in a loosening position, said teeth on said upper surface engaging said second teeth when said second arm is raised onto said bottom side, said teeth on said upper surface engaging said front surface of said second teeth when said lever is urged into said engaged position such that said second arm rotates said gear in a second direction, said teeth on said upper surface sliding over said top surface of said second teeth when said lever is biased into said disengaged position such that said gear is not rotated, each of said first arm and said second arm being positioned on opposite sides of said shaft with respect to each other;

a blade being slidably disposed in said handle, said blade being extendable outwardly through said slot in said second end of said handle for cutting with said blade, said blade being retractable into said interior of said handle for storing said blade; and a blade switch being slidably integrated into said outer wall of said handle, said blade switch being slidable along an axis extending between said first end and said second end of said handle, said blade switch being in mechanical communication with said blade for extending or retracting said blade.

* * * * *